US009572439B2

(12) United States Patent
Pitchforth et al.

(10) Patent No.: US 9,572,439 B2
(45) Date of Patent: Feb. 21, 2017

(54) SLEEPING BAG WITH INTEGRATED INFLATABLE GROUND MAT

(71) Applicant: Eddie Bauer LLC, Bellevue, WA (US)

(72) Inventors: Noah Pitchforth, Issaquah, WA (US); Mark Correll, Carnation, WA (US)

(73) Assignee: Eddie Bauer LLC, Bellevue, WA (US)

( * ) Notice: Subject to any disclaimer, the term of this patent is extended or adjusted under 35 U.S.C. 154(b) by 36 days.

(21) Appl. No.: 14/333,670

(22) Filed: Jul. 17, 2014

(65) Prior Publication Data

US 2015/0020309 A1 Jan. 22, 2015

Related U.S. Application Data

(60) Provisional application No. 61/856,451, filed on Jul. 19, 2013.

(51) Int. Cl.

| | |
|---|---|
| ***A47G 9/08*** | (2006.01) |
| ***A47C 27/08*** | (2006.01) |
| *A47G 9/00* | (2006.01) |

(52) U.S. Cl.

CPC ..... *A47G 9/086* (2013.01); *A47C 27/081* (2013.01); *A47G 9/08* (2013.01);

(Continued)

(58) Field of Classification Search

CPC ..... A47C 27/08; A47C 27/081; A47C 27/082; A47C 27/083; A47C 27/084; A47G 2009/003; A47G 9/06; A47G 9/062; A47G 9/08; A47G 9/083; A47G 9/086

See application file for complete search history.

(56) References Cited

U.S. PATENT DOCUMENTS

| | | | | |
|---|---|---|---|---|
| 2,620,493 A | | 12/1952 | Brelsford | |
| 3,798,686 A | * | 3/1974 | Gaiser | A47C 27/084 5/413 AM |

(Continued)

FOREIGN PATENT DOCUMENTS

| | | |
|---|---|---|
| DE | 8811253 | 11/1988 |
| DE | 4437633 | 5/1996 |

(Continued)

OTHER PUBLICATIONS

Extended European Search Report for European Patent Application No. 14177773.0, dated Nov. 26, 2014 8 pages.

*Primary Examiner* — Nicholas Polito
*Assistant Examiner* — David R Hare
(74) *Attorney, Agent, or Firm* — Sheridan Ross P.C.

(57) ABSTRACT

This disclosure relates to a novel system, device, and method for providing a sleeping bag with an integrated ground mat that provides thermal comfort by effectively retaining heat and is lightweight, compact, and easily packed for transport or storage. The sleeping bag with integrated air mattress allows the user to bring only one item that doubles as a sleeping bag and a ground mat. Additionally, the integrated ground mat remains positioned under the user while the user is sleeping. The sleeping bag may have an integrated ground mat, an inner shell, an outer shell, insulation between the inner and outer shells, an upper portion and a lower portion forming a sleeping cavity, an opening for access into the sleeping cavity, a draft tube, and a means for opening and closing the sleeping bag opening.

14 Claims, 8 Drawing Sheets

(52) U.S. Cl.
CPC ... *A47G 2009/003* (2013.01); *Y10T 29/49826* (2015.01); *Y10T 29/49947* (2015.01)

(56) References Cited

U.S. PATENT DOCUMENTS

| | | | | | |
|---|---|---|---|---|---|
| 3,877,092 | A | | 4/1975 | Gaiser | |
| 4,787,105 | A | * | 11/1988 | Phillips | A47G 9/086 128/201.13 |
| 4,862,533 | A | * | 9/1989 | Adams, III | A47C 27/081 417/472 |
| 4,894,878 | A | * | 1/1990 | Roach | A47G 9/086 2/272 |
| 4,896,387 | A | | 1/1990 | Malcolm et al. | |
| 4,989,282 | A | * | 2/1991 | Goldstein | A47G 9/086 2/69.5 |
| 4,996,733 | A | * | 3/1991 | Tsai | A47C 27/081 5/413 R |
| 5,152,017 | A | * | 10/1992 | Jaeger | A47G 9/086 2/69.5 |
| 5,392,477 | A | | 2/1995 | Wolter et al. | |
| 5,483,713 | A | | 1/1996 | Kikuchi et al. | |
| 5,528,779 | A | * | 6/1996 | Lee | A47C 7/66 2/69.5 |
| 5,553,339 | A | * | 9/1996 | Thomas | A47C 27/081 5/413 AM |
| 5,640,725 | A | * | 6/1997 | Ando | A47G 9/086 5/413 AM |
| 5,669,088 | A | * | 9/1997 | McNamee | A47G 9/086 135/116 |
| 5,735,003 | A | | 4/1998 | Judge | |
| 5,740,565 | A | | 4/1998 | McDade | |
| 5,974,608 | A | * | 11/1999 | Haller | A47C 27/084 5/420 |
| 6,321,400 | B1 | | 11/2001 | Gulino | |
| 6,675,414 | B2 | | 1/2004 | Lamke | |
| 6,799,339 | B2 | | 10/2004 | Stewart | |
| 6,832,629 | B2 | | 12/2004 | Wu | |
| 6,990,696 | B2 | | 1/2006 | Stewart et al. | |
| 7,051,386 | B2 | | 5/2006 | Stewart et al. | |
| 7,386,898 | B1 | | 6/2008 | Brun | |
| 8,499,381 | B1 | * | 8/2013 | Miller | A47G 9/086 2/69.5 |
| 8,707,479 | B2 | * | 4/2014 | Benninger | A47G 9/086 2/69.5 |
| 8,726,432 | B1 | * | 5/2014 | Benninger | A47G 9/086 5/413 R |
| 2002/0078501 | A1 | * | 6/2002 | Lamke | A47G 9/086 5/413 AM |
| 2002/0104162 | A1 | * | 8/2002 | Stewart | A47C 27/081 5/413 AM |
| 2002/0133879 | A1 | | 9/2002 | Smith | |
| 2004/0216238 | A1 | | 11/2004 | Stewart et al. | |
| 2006/0021139 | A1 | | 2/2006 | LaVigne | |
| 2007/0209114 | A1 | * | 9/2007 | Chu | A47G 9/086 5/413 AM |
| 2010/0031447 | A1 | | 2/2010 | Huang | |
| 2010/0107332 | A1 | * | 5/2010 | Brune | A47C 17/64 5/413 AM |
| 2010/0299832 | A1 | * | 12/2010 | Alford | A47G 9/086 5/413 AM |
| 2011/0173749 | A1 | * | 7/2011 | Martray | A47G 9/086 5/413 R |
| 2014/0345051 | A1 | * | 11/2014 | Benninger | A47G 9/086 5/413 R |
| 2015/0164249 | A1 | * | 6/2015 | Scott | A47G 9/086 5/413 R |

FOREIGN PATENT DOCUMENTS

| | | |
|---|---|---|
| DE | 19522322 | 1/1997 |
| DE | 19830452 | 1/2000 |
| DE | 10023095 | 8/2001 |
| DE | 202006011345 | 10/2006 |
| DE | 202006011389 | 10/2006 |
| DE | 202007010103 | 11/2007 |
| DE | 202009009729 | 10/2009 |
| DE | 202009009730 | 10/2009 |
| DE | 202011103349 | 9/2011 |
| DE | 202011103350 | 9/2011 |
| EP | 0286291 | 10/1988 |
| EP | 1552770 | 7/2005 |
| FI | 892601 | 5/1989 |
| FR | 2481589 | 11/1981 |
| FR | 2682270 | 4/1993 |
| FR | 2699384 | 6/1994 |
| FR | 2713902 | 6/1995 |
| FR | 2922739 | 5/2009 |
| GB | 689258 | 3/1953 |
| GB | 2326818 | 1/1999 |
| GB | 2473613 | 3/2011 |
| JP | H09-182653 | 7/1997 |
| JP | H08-154797 | 6/1999 |
| JP | 2001-37609 | 2/2001 |
| WO | WO 89/02963 | 11/1990 |
| WO | WO 91/11562 | 8/1991 |

* cited by examiner

SLEEPING BAG WITH INTEGRATED INFLATABLE GROUND MAT

CROSS-REFERENCE TO RELATED APPLICATIONS

This application claims priority under 35 U.S.C. §119(e) to U.S. Provisional Patent Application Ser. No. 61/856,451 filed Jul. 19, 2013, which is incorporated herein in its entirety by reference.

FIELD OF THE INVENTION

Embodiments of the present invention generally relate to sleeping bags with integrated inflatable ground mats that also provide thermal efficiency and comfort.

BACKGROUND OF THE INVENTION

Camping and hiking are currently enjoying a surge in popularity. However, people now have enhanced expectations of comfort and convenience while camping, and a large demand exists for products providing both comfort and convenience. Further, there are many different ways in which people like to camp. Some carry their equipment to remote places and require light and easily packed equipment, while others camp alongside their vehicles and primarily require comfort. Sleeping is one activity that is hard to perform well without a minimal comfort level. The surface upon which a camper sleeps can be very important in determining the level of comfort. In order to isolate the sleeper from the hardness and irregularities of the ground, it has become the practice of many campers to use an air mattress, which is basically a thick flat rubber balloon that can be interposed between the sleeper's sleeping bag and the ground.

There may be certain problems associated with using a sleeping bag with a separate air mattress. As a sleeping person turns in his sleep, the bag, which may be made of nylon or some other somewhat slippery material, may tend to slide off of the air mattress, and no camper likes to wake up in his sleeping bag to find himself rolled off of his mat. Additionally, campers can rarely find a perfectly flat spot to put their sleeping bags and their ground mats, so they often slide off of their air mattresses. While a tradeoff between ultra-comfort and ultra-light construction has previously seemed inevitable in sleeping bag design, the current invention provides more comfort and reliability in a lightweight sleeping bag.

Two primary considerations for comfort are the sleeping bag's ability to retain heat and the sleeping bag's ability to firmly support the user, even though the sleeping bag may be placed on uneven ground. While air mattresses have been found to support the user well, regardless of imperfections in the ground, the large air pockets currently used allow convective currents to form, robbing heat from the mattress. Foam, goose down, synthetic fibers, and other insulation materials are merely a means to hold small pockets of air. If an air mattress can be made with small pockets of air instead of large pockets, convective currents will not be able to form and the air mattress will retain more heat.

Temperature ratings are created with the assumption that you are using a sleeping pad because when a user lies in a sleeping bag, the user is compressing the fill material, whether it is down or synthetic, and thus reducing the loft and insulating capabilities of the bag. A sleeping pad puts another couple inches of insulation between the user and the cold ground, increasing the thermal effectiveness of the bag.

Various proposals for sleeping bags that incorporate air mattresses are found in the art. U.S. Pat. No. 3,877,092 discloses a self-inflatable air mattress and sleeping bag that traps air inside an airtight jacket filled with foam. Means are included to manually increase the air pressure inside the foam-filled jacket.

Further, numerous sleeping bag designs have been utilized with a plurality of parallel and longitudinally extended air compartments along with various improvements over the prior art. Such devices may be found in U.S. Pat. Nos. 4,996,733; 5,528,779; 5,553,339; 5,740,565; and 5,974,608, all of which are incorporated by reference herein in their entireties.

While possibly effective for their intended purposes, none of the above proposals provide an air mattress that can effectively retain heat by reducing large air pockets, provide a comfortable place to sleep, are lightweight and not bulky, and can be easily packed. Instead, prior art designs typically use air mattresses with large air pockets or are completely filled with foam.

Therefore, it is desirable to have a sleeping bag with an integral air mattress that effectively retains heat, is comfortable, is lightweight and compact, can be easily packed, is convenient to use, and does not require an excessive volume of air to inflate.

SUMMARY OF THE INVENTION

These and other needs are addressed by the various embodiments and configurations of the present invention. This disclosure relates to a novel system, device, and method for providing a sleeping bag with an integrated, inflatable ground mat that has improved heat transfer characteristics and provides improved comfort. Note that the terms "ground mat," "air mat," "air mattress," "pad," "sleeping pad," "bladder," "inflatable bladder," "inflatable member," and "mat" may be used herein interchangeably. The novel sleeping bag with an integrated ground mat provided herein allows the user to bring only one item that doubles as a sleeping bag and a ground mat that effectively retains heat.

Another aspect of embodiments of the invention is to provide a sleeping bag with a ground mat that also provides thermal comfort by effectively retaining heat. In some embodiments of the present invention, the ground mat comprises a plurality of baffles that form a plurality of channels. Insulation may be disposed in at least one of the plurality of baffles to provide improved heat transfer characteristics such as thermal resistance, etc. Further, the channels may be segmented and discretized such that various channels may be filled with different types of insulation or other materials to provide variable heat transfer characteristics throughout the ground mat.

Still another aspect of embodiments of the present invention is to provide a sleeping bag with an integrated, inflatable ground mat that is lightweight, compact, and easily stored. The sleeping bag with integrated ground mat should be able to be easily compressed down to the size of a traditional sleeping bag without a ground mat. To pack the sleeping bag, the inflatable ground mat is deflated, causing the mat and insulation to shift from an expanded to a compressed configuration, taking up a minimal amount of space. One advantage of some embodiments is that the sleeping bag with the integrated ground mat takes up less space than a traditional sleeping bag and separate ground mat. In some embodiments of the present invention, the sleeping bag may be stuffed into a compression stuff sack to reduce the volume of the stored sleeping bag with an integrated mat. The compression stuff sack may have pull chords, straps with buckles, and/or a compression cap.

It is one aspect of various embodiments of the present invention to provide a sleeping bag with a ground mat, such that the user does not slide off of his ground mat, and that is comfortable to use, i.e., sleep on. In some embodiments of the present invention, the ground mat is integrally fixed to the sleeping bag. In other embodiments of the present invention, the ground mat is selectively interconnected to the sleeping bag such that a user may or may not include the ground mat. In yet further embodiments, the ground mat may be selectively interconnected to an inner shell of the sleeping bag through the interior of the sleeping bag such that the ground mat is disposed inside of the sleeping bag. Thus, it is one aspect of various embodiments of the present invention to provide a sleeping bag with an integrated ground mat, such that the user does not slide off of his ground mat, and that is comfortable to use, i.e., sleep on. Another aspect of embodiments of the invention is to provide a sleeping bag with an integrated air mattress and that also provides thermal comfort by effectively retaining heat.

It is another aspect of various embodiments to provide a sleeping bag with an integrated ground mat shaped similar to a human body. Thus, the top (head) end of the sleeping bag and mat may be small, like a human head. The shoulder and chest portion of the sleeping bag and mat may be wider than the top end to accommodate the user's chest and arms. The sleeping bag and mat may then be tailored down to a narrower width or smaller circumference at the bottom (feet) end than the width/circumference at the shoulder portion. In some embodiments the circumference of the foot portion may gradually increase from approximately the user's calves or ankles down to the end to match the perimeter of the foot panel so that the user has room for his feet.

In various embodiments, a sleeping bag is provided with two or more of the following: an integrated inflatable ground mat, an inner shell, an outer shell, insulation between the inner and outer shells, an upper portion and a lower portion forming a sleeping cavity, inner pockets on the inner shell, a head portion that may be drawn around the user's head, a draft collar, an opening for access into the sleeping cavity, a draft tube, and a means for opening and closing the sleeping bag opening. In some embodiments, the opening and closing means may be a zipper. Any zipper or other closure mechanism, i.e., Velcro®, clasps, etc. known in the art may be used. One embodiment of the present invention comprises a zipper guard around the opening proximate the zipper.

In one embodiment, a sleeping bag is provided with an integrated air mattress comprising an inner shell, an outer shell, an inflatable mat, insulation, and one or more openings to selectively inflate the mat. The inner shell may have an inner and an outer surface. The inner shell's inner surfaces are positioned adjacent the mat.

In some embodiments, the ground mat comprises one or more valves to inflate and deflate the mat. The valves may be any known valves in the art. For example, the one or more valves may be two valves: one to inflate the mat and one to deflate the mat. Alternatively, the mat may only comprise one valve that can be used both to inflate and deflate the mat.

In one embodiment, the sleeping bag with integrated air mattress is placed where the user wants to sleep, and the air input means are used to impart a stream of air to the inflatable mat, thus inflating the inflatable tubes, channels, or baffles. When the inflatable mat is inflated, the insulation positioned in the channels is stretched to an expanded configuration. The user may then enter the sleeping bag with integrated air mattress through the opening defined by the sleeping bag inner shell. When the user is ready to pack up the sleeping bag with integrated air mattress, the inflatable mat is deflated, causing the inflatable mat and the insulation positioned in the channels to shift to a compressed configuration. The sleeping bag with integrated air mattress may then be easily packed, taking up a minimal amount of space.

Features of the present disclosure may be employed in a wide range of applications, including clothing, camping, backpacking, cycling, traveling, boating, and other sleeping or resting applications, to name a few. Although the invention generally relate to sleeping bags and inflatable ground mats, the invention and features described herein could easily be implemented on blankets, chairs, jackets, clothing, seat cushions, and other similar applications.

Another aspect of the present invention is to provide a method for manufacturing a sleeping bag with an integrated, inflatable ground mat. More specifically, in one embodiment, a method for forming a sleeping bag with a ground mat is provided comprising providing an impermeable member capable of retaining air, inserting one or more baffles into the impermeable member, inserting insulation into the one or more baffles, covering the underside (ground side) of the mat with a first inner shell material, covering the upper side (side on which the user lies) of the mat with a second inner shell material, securing the first inner shell material to the underside of the mat, trimming the first inner shell material to follow the shape of the mat, securing the second inner shell material to the upper side of the mat, trimming the second inner shell material to follow the shape of the mat, covering the underside of the ground mat with a water-resistant outer shell, covering the sides (between the upper side and the underside) and upper side of the ground mat with the sleeping bag or with a second outer shell material, securing the sleeping bag or second outer shell to at least one of the water-resistant underside outer shell, the mat, the first inner shell, and the second inner shell. In some embodiments, the sleeping bag may have multiple layers of material and insulation between the layers of material.

One aspect of the present invention is to provide a method for manufacturing an inflatable bladder to be integrated with a sleeping bag. More specifically, in one embodiment, a method of forming an inflatable bladder for integration with a sleeping bag comprises providing a impermeable bladder material, placing insulation on top of a portion of the impermeable bladder material, folding the impermeable bladder material, welding one or more seams into two layers of impermeable bladder material to interconnect the two layers of impermeable bladder material, inserting one or more baffles into said inflatable bladder, sealing the two layers of impermeable bladder material such that the inflatable bladder is sealed, and inserting one or more valves into the inflatable bladder.

In one embodiment, a sleeping bag with an integrated ground mat is provided, comprising: an outer shell having an outer shell upper portion and an outer shell lower portion; an inner shell having an inner shell upper portion and an inner shell lower portion; an upper portion of the sleeping bag comprised of the inner shell upper portion, the outer shell upper portion, and insulation of a first type; a lower portion of the sleeping bag comprised of the integrated ground mat, the inner shell lower portion, and the outer shell lower portion, wherein the lower portion has an upper side and an underside; one or more baffles; a first opening defined by an edge of the upper portion and an edge of the lower portion;

a means for opening and closing the first opening; a sleeping cavity defined by the inner shell upper portion, the inner shell lower portion, a sealed side, and the first opening; a sealed bottom end; a top end opposite the bottom end and comprising a second opening; and wherein the ground mat comprises two or more channels; an inner shell with a lower portion on an underside and an upper portion opposite the lower portion, the two or more channels positioned between the mat inner shell upper portion and the mat inner shell lower portion; insulation of a second type; and one or more openings to selectively inflate and deflate the mat.

One embodiment of the present invention is a sleeping bag and combination ground mat comprising an outer shell having an upper portion and a lower portion; an inner shell having an upper portion and a lower portion; an upper portion of the sleeping bag comprised of the inner shell upper portion and the outer shell upper portion; a lower portion of the sleeping bag comprised of an integrated ground mat, the inner shell lower portion, and the outer shell lower portion; wherein the ground mat comprises: an inflatable member forming an enclosed volume, the inflatable member having an top side and a bottom side, the top side positioned opposite the bottom side; a plurality of baffles positioned between the top side and the bottom side of the inflatable member, the plurality of baffles forming a plurality of channels; an insulation material disposed in at least one of said plurality of channels; and one or more openings to selectively inflate and deflate the enclosed volume of the inflatable member.

Another embodiment of the present invention is a method for manufacturing a sleeping bag with an inflatable ground mat, comprising providing a inflatable member forming an enclosed volume, the inflatable member having an top side and a bottom side, the top side positioned opposite the bottom side; inserting a plurality of baffles positioned between the top side and the bottom side of the inflatable member, the plurality of baffles forming a plurality of channels; inserting an insulation material in at least one of said plurality of channels; inserting one or more valves into the inflatable member; securing a lower portion of the sleeping bag to the inflatable member to form the sleeping bag with the inflatable ground mat.

A further embodiment of the present invention is a sleeping bag with an integrated ground mat comprising an outer shell having an upper portion and a lower portion; an inner shell having an upper portion and a lower portion; an upper portion of the sleeping bag comprised of the inner shell upper portion and the outer shell upper portion; a lower portion of the sleeping bag comprised of an integrated ground mat, the inner shell lower portion, and the outer shell lower portion; a first opening defined by an edge of the upper portion and an edge of the lower portion; a zipper for opening and closing the first opening; a sleeping cavity defined by the inner shell upper portion, the inner shell lower portion, a sealed side, and the first opening; a sealed bottom end comprising a footbox, wherein the footbox separates the upper portion and the lower portion of the sleeping bag; a top end opposite the bottom end and comprising a second opening; wherein the ground mat comprises: a inflatable member forming an enclosed volume, the inflatable member having an top side and a bottom side, the top side positioned opposite the bottom side; a plurality of baffles positioned between the top side and the bottom side of the inflatable member, the plurality of baffles oriented along a substantially longitudinal direction of the inflatable member, and the plurality of baffles forming a plurality of channels; an insulation disposed in at least one of the plurality of channels; and one or more openings to selectively inflate and deflate the enclosed volume of the inflatable member.

For purposes of further disclosure, the following references generally related to sleeping bags with integrated air mattresses are hereby incorporated by reference in their entireties: U.S. Pat. Pub. No. 2006/0021139 to LaVigne published on Feb. 2, 2006; U.S. Pat. Pub. No. 2010/0299832 to Alford published on Dec. 2, 2010; Great Britain Pat. App. No. 2473613 to Joyce; U.S. Pat. No. 6,675,414 to Lamke issued on Jan. 13, 2004; U.S. Pat. No. 7,051,386 to Stewart et al. issued on May 30, 2006; and U.S. Pat. No. 6,321,400 to Gulino issued on Nov. 27, 2001.

The phrases "at least one", "one or more", and "and/or", as used herein, are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about."

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, appendices, abstract, and claims themselves.

These and other advantages will be apparent from the disclosure of the invention(s) contained herein. The above-described embodiments, objectives, and configurations are neither complete nor exhaustive. The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings, Detailed Description, and Appendices, and no limitation as to the scope of the present invention is intended by either the inclusion or non-inclusion of elements, components, etc. in this Summary of the Invention. Additional aspects of the present invention will become more readily apparent from the Detailed Description, particularly when taken together with the drawings and appendices.

BRIEF DESCRIPTION OF THE DRAWINGS

The accompanying drawings, which are incorporated in and constitute a part of the specification, illustrate embodiments of the invention and together with the summary of the invention given above and the detailed description of the drawings given below, serve to explain the principles of these embodiments. Those of skill in the art will recognize that the following description is merely illustrative of the principles of the invention, which may be applied in various ways to provide many different alternative embodiments. In certain instances, details that are not necessary for an understanding of the disclosure or that render other details difficult to perceive may have been omitted. It should be understood, of course, that the invention is not necessarily limited to the particular embodiments illustrated herein. Additionally, it should be understood that the drawings are not necessarily to scale.

A component list of the various components shown in drawings is provided herein:

| Number | Component |
|---|---|
| 2 | Sleeping Bag |
| 4 | Mat |
| 6 | Top End |
| 8 | Bottom End |
| 10 | Upper Side |
| 12 | Lower Side |
| 14 | Outer Shell |
| 16 | Opening |
| 18 | Hood |
| 20 | Zipper |
| 22 | Channel |
| 24 | Baffle |
| 26 | Seam |
| 28 | Valve |
| 30 | Inner Shell |
| 32 | Draft Collar |
| 34 | Draft Tube |
| 36 | Pocket |
| 38 | Stitching |
| 40 | Upper Portion |
| 42 | Lower Portion |
| 44 | Footbox |
| 46 | Stuff Sack |
| 48 | Lid |
| 50 | Adjustable Strap |
| 52 | Flash |

DETAILED DESCRIPTION

Those of skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings and appendices, which are incorporated in and constitute a part of the specification, illustrate embodiments of the invention and serve to explain the principles of the invention. It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

Figure 1:
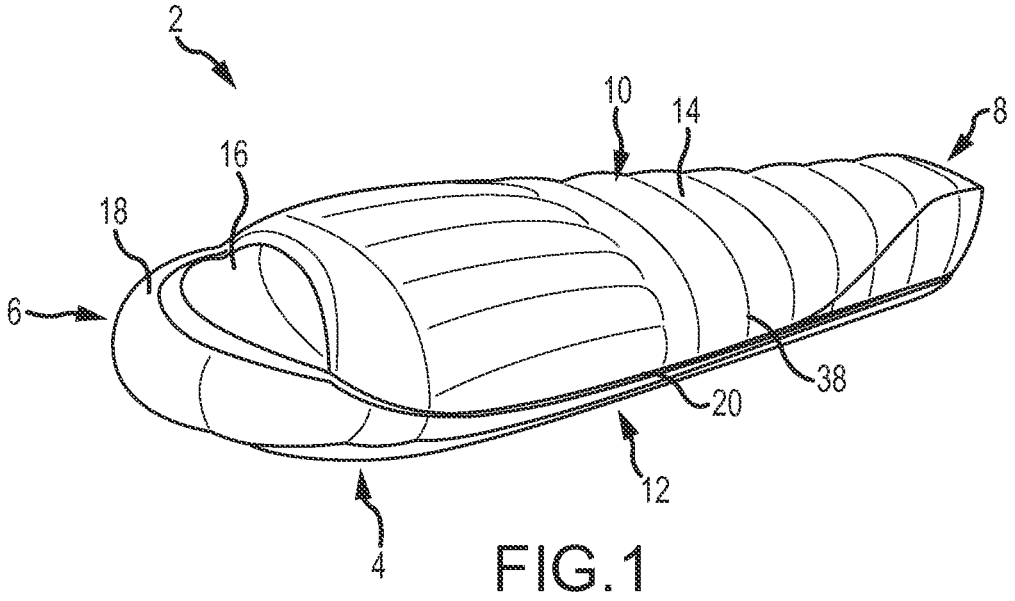
FIG. 1 is an isometric view of a sleeping bag with an inflatable ground mat.

Now referring to FIG. 1, an isometric view of a sleeping bag 2 with an inflatable ground mat 4 is provided. In this embodiment, the sleeping bag 2 comprises a top end 6, a bottom end 8, an upper side 10, and a lower side 12. Further, the sleeping bag 2 depicted in FIG. 1 comprises an outer shell 14 and an inner shell (shown in FIG. 5). The sleeping bag 2 may comprise a sealed edge and an opening edge that includes a zipper 20. A user may enter the sleeping bag 2 through the opening edge, then close the opening edge with the zipper 20. Once inside, the user may orient himself or herself such that the user's head is disposed in a hood 18, and the user's face is disposed in an opening 16.

In one embodiment, the hood 18 or top end 6 of the sleeping bag 2 may be drawn around the user's head with a drawstring, pull chord, or other tightening means. Even when the tightening means is fully drawn, the user's face may still remain exposed through the opening 16. The hood 18 may comprise multiple layers and may have insulation between the layers; examples of insulation materials may be those commonly known in the art or described elsewhere herein. The hood 18 of the sleeping bag 2 may also comprise a comfort tube to more comfortably wrap the head portion around the user's head. The comfort tube may also cover portions of a user's face.

The sleeping bag 2 shown in FIG. 1 comprises stitching 38 between the outer shell 14 and the inner shell. In some embodiments of the present invention, the sleeping bag 2 comprises insulation between the outer shell 14 and the inner shell. The insulation may help weatherproof the sleeping bag 2 against inclement or unfavorable environmental conditions. The stitching 38 may help keep the insulation evenly distributed throughout the sleeping bag to improve the weatherproof aspects of the sleeping bag 2. Without stitching 38, the insulation may be prone to bunching up in certain areas between the outer shell 14 and the inner shell, which in turn leads to cold spots due to large air pockets. Other embodiments of the present invention may include welded seams or any other connecting means that do not perforate the outer shell 14 in order to enhance the water resistant or water proof qualities of the sleeping bag 2.

In some embodiments the sleeping bag 2 has a traditional quilted pattern. In other embodiments the sleeping bag 2 may be sewn into chambers or sections. For example, the chambers run longitudinally proximate the user's chest and laterally proximate the user's legs. Alternatively, the chambers run longitudinally throughout the sleeping bag 2, or the chambers run laterally throughout the sleeping bag 2. In various embodiments of the present invention, the sleeping bag 2 may have reinforced stitching and/or rip-stop seams.

As mentioned above, various portions of the sleeping bag 2 and/or ground mat 4 may include insulation. The insulation may be down, other natural feathers, or a synthetic material. Advantages of down are that it wicks away body moisture and allows the body moisture to evaporate. Moisture wicking goes a long way in keeping the user dry, warm, and comfortable. Synthetic insulation is water resistant and will provide warmth when wet. Synthetic fills are resistant to moisture and some will actually shed the water rather than absorb it. Synthetic insulation also dries quickly because the moisture is trapped in the air pockets between the fibers rather than in the fibers themselves. In one embodiment, the upper side 10 of the sleeping bag 2 is filled with Downtek GGD 850 fill insulation and the lower side 12 is filled with Climashield HL 5.4 OZ/SQ YD. Additional examples of insulation are wool, PolarGuard, Quallofil, Hollofil, Thermolite, or any other insulation commonly known in the art. The outer shell 14 may be a material similar to EBO-109 19-3906 TCX. The outer shell 14 may alternatively be PB157-DWR, 15D Nylon Ripstop. The inner shell may be the same material or a different material, such as M598 0112KP89, 30D Nylon Taffeta. One skilled in the art will appreciate additional materials used to comprise the outer shell 14 or inner shell 30 that are commonly known in the art. In addition, one skilled in the art will appreciate a variety of combinations of insulation material in a variety of locations in the sleeping bag 2 and/or ground mat 4.

In some embodiments, the outer shell 14 may be all weatherproof. If the entire outer shell 14 is weatherproof (i.e., total weatherproofing of the sleeping bag 2), then the sleeping bag 2 with ground mat 4 may be used as a tent, too. In this embodiment, the outer shell 14 may be used instead of a bivouac or water-resistant bag. The sleeping bag 2 may also be used for super lightweight applications, such as for cycling or survival, where a tent is not carried.

Figure 2:
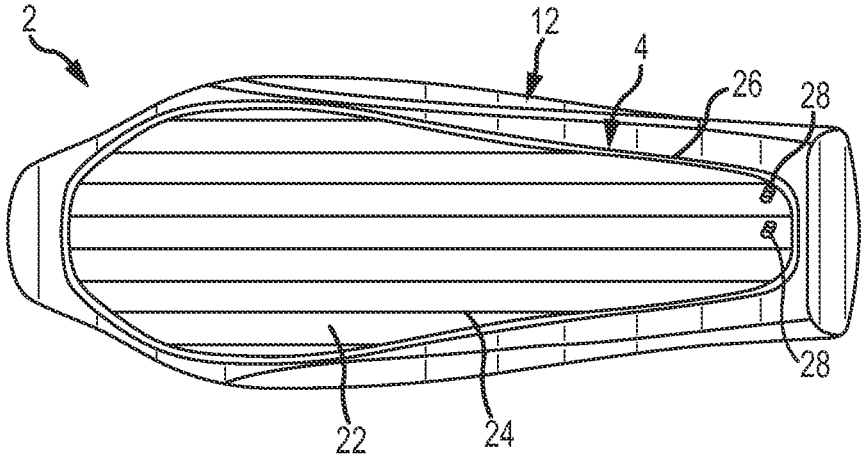
FIG. 2 is a bottom plan view of the sleeping bag of FIG. 1, wherein the inflatable ground mat is disposed on a lower side of the sleeping bag.

Now referring to FIG. 2, a bottom plan view of a sleeping bag 2 with an inflatable ground mat 4 is provided. In this embodiment, the inflatable ground mat 4 is disposed on the lower side 12 of the sleeping bag 2, and the ground mat 4 generally extends between the top end 6 and the bottom end 8 of the sleeping bag 2. Further, the ground mat 4 generally extends between the sealed edge and the opening edge, which comprises a zipper 20. One skilled in the art will appreciate various configurations of the ground mat 4 wherein the ground mat 4 may extend to different sizes and may be positioned in different locations.

In the embodiment depicted in FIG. 2, the mat 4 includes a plurality of channels 22, which are separated by baffles 24. The inflatable ground mat 4 comprises an inflatable member that defines an internal volume. The inflatable member is at least partially defined by a top side and a bottom side, wherein the bottom side is positioned opposite the top side. In this embodiment, a plurality of baffles 24 is connected to both the top side and the bottom side of the inflatable member of the mat 4, and the baffles 24 run down the longitudinal length of the inflatable member. This configuration of baffles 24 maintains the position of the top side of the inflatable member in relative proximity to the bottom side. One skilled in the art will appreciate a variety of baffle 24 configurations. For example, in a further embodiment, the plurality of baffles 24 runs laterally across the mat 4. Further yet, baffles 24 may be disposed at angles offset from the longitudinal and lateral direction, and the baffles 24 may be a line shape other than straight such as curved, rounded, or warped. The baffles 24 may be arranged in different configurations in different sections of the mat 4. For example, the top end 6 of the mat 4 may comprise longitudinally-oriented baffles 24 whereas the bottom end 8 of the mat 4 may comprise laterally-oriented baffles 24.

The plurality of baffles 24 may form a plurality of channels 22, or spaces between the baffles 24. These channels 22 may house an insulating material, a non-insulating material, or no material depending on the requirements of the sleeping bag 2. In some embodiments, one or more valves 28 may be disposed in fluid communication with the internal volume of the inflatable ground mat 4. A user may transfer a gas or fluid such as air through the one or more valves 28 and into the internal volume of the inflatable ground mat 4. When fully inflated, the mat 4 provides a cushion between the user inside of, or on top of, the sleeping bag 2 and the surface on which the sleeping bag 2 is disposed. Thus, if a user is sleeping in an environment with an unforgiving surface such as rocky ground, then the inflatable ground mat 4 provides a comfortable surface for the user to rest on.

The inflatable ground mat 4 may also be connected to the sleeping bag 2 via a seam 26. In some embodiments, the seam 26 is a stitched thread, a welded seam, or other means to integrally fix the ground mat 4 to the sleeping bag 2. In other embodiments, the seam 26 may be a selective interconnection between the ground mat 4 to the sleeping bag 2. For example the seam 26 may be a zipper disposed about a perimeter of the ground mat 4, a snap on fastener, a belt, Velcro®, etc. These embodiments of the seam 26 allow a user to remove the ground mat 4 from the sleeping bag 2 and use the sleeping bag 2 conventionally, i.e., without the additional ground mat 4.

The selective interconnection also allows for a user to attach only portions or segments of the ground mat 4 to the sleeping bag 2. In one embodiment, the ground mat 4 comprises three segments: an upper segment directed to the head and shoulders, a middle segment directed to the lower back, and a lower segment directed to the legs. Each segment may comprise one or more valves 28 and one or more seams 26 for selective interconnection to the sleeping bag 2. Thus, a user may adjust the gage pressure of each individual segment to suit the user's needs. Further, the user may selectively interconnect only some of the segments. The user may only desire slight lower back support, and thus may only attach a partially inflated middle segment to the sleeping bag 2. One skilled in the art will appreciate a variety of segmented, and selectively interconnected ground mat configurations.

Again, referring to FIGS. 1 and 2, the ground mat 4 need not be disposed proximate to the outer shell 14. In some embodiments, the ground mat 4 may disposed inside of the sleeping bag 2 and proximate to the inner shell. The seam 26 may be disposed inside of the sleeping bag 2 to integrally fix or selectively interconnect the ground mat 4 to the sleeping bag. In this configuration, the ground mat 4 may be an integrated air mattress. Thus, the user may store, pack, and unveil the sleeping bag 2 normally but have the added benefit of the concealed ground mat 4. In one embodiment, the sleeping bag 2 may have a cushion or memory foam on top of the ground mat 4 such that the user lies on the cushion or memory foam. Alternatively, the ground mat 4 may have a layer of insulation or down on top of the mat 4 rather than inside the mat 4. In some embodiments the sleeping bag 2 comprises an air mattress which may have a mat or a pad on the bottom side of the sleeping bag air mattress to protect the air mattress from puncturing, to provide further support, to provide additional comfort, to provide additional water proofing, and/or to provide additional thermal insulation. The pad may have various shapes and patterns.

Figure 3:
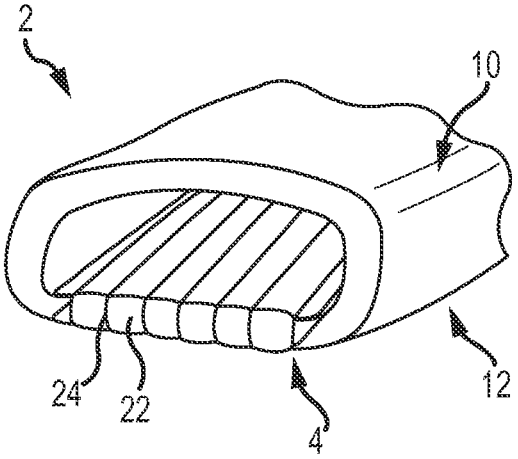
FIG. 3 is a cross-sectional view of a sleeping bag with an inflatable ground mat taken along a lateral plane.

Now referring to FIG. 3, an isometric view of a sleeping bag 2 with an inflatable ground mat 4 is shown wherein the interior of the sleeping bag 2 is visible. As described above, the ground mat 4 comprises a plurality of baffles 24 which form a plurality of channels 22. In some embodiments of the present invention, insulation may be inserted in at least one of the channels 22. In other embodiments, the channels 22 may be filled with a solid, compressible core material or simply air. Further, the channels 22 may be segmented in different regions of the sleeping bag 2. For example, a channel 22 under the lower back of the user may be comprised of a solid foam material with enhanced support properties, and a channel 22 under the feet of the user may be comprised of insulation material with enhanced heat transfer properties. In yet a further example, the ground mat 4 comprises a plurality of bladders or inflatable members such that different regions underneath the user may not only be filled with different materials, but may be filled with differing air pressures. One skilled in the art will appreciate various combinations of channel 22 locations, inflatable members or bladders, and materials within the channels 22, inflatable members or bladders.

Figure 4:
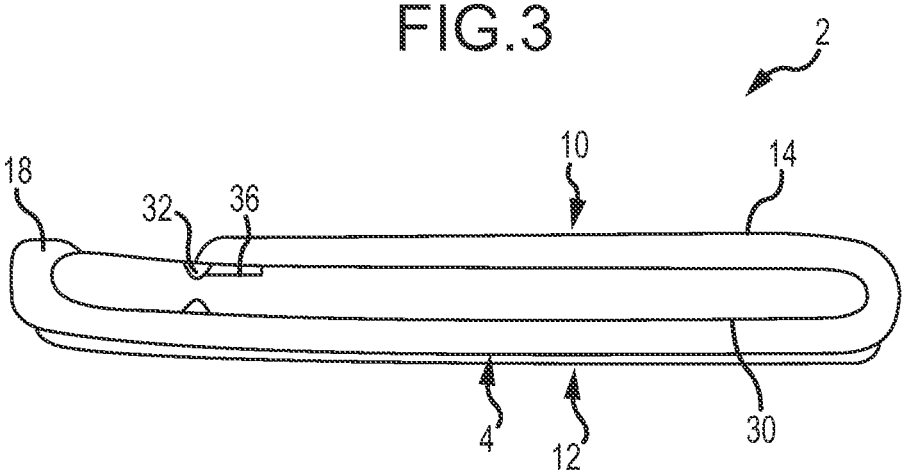
FIG. 4 is a cross-sectional view of a sleeping bag with an inflatable ground mat taken along a longitudinal plane.

Now referring to FIG. 4, in some embodiments of the present invention the sleeping bag may have a draft collar 32, which may be a fully insulated tube of nylon on the upper side 10 and lower side 12 of the inner shell 30 of the sleeping bag 2 across the shoulders and neck area, to prevent drafts from the face opening 16. The draft collar 32 may range in width from 1 inch to 5 inches. In one embodiment of the present invention the sleeping bag 2 has a draft tube, which is a fully insulated tube of nylon positioned proximate to the bag opening means (such as a zipper 20, for example) to prevent drafts through the opening 16. In other embodiments, the draft tube may be continuous from the opening means around the face opening to serve both as a draft tube and a draft collar 32. Some embodiments may also comprise a side-block baffle, which is piece of fabric sewn into the side of the bag 2 to prevent the movement of down or other insulation.

In one embodiment, the inner shell 30 of the sleeping bag 2 may have one or more inner pockets 36 with or without zippers. The pockets 36 will preferably be on the upper portion 10 of the sleeping bag 2 to avoid uncomfortable pockets under the user's body. The pockets 36 may be used to store small items such as batteries, pocket flashlights, watches, pill bottles, cameras, cell phones, etc. that the user would want to have in close proximity.

Figure 5:
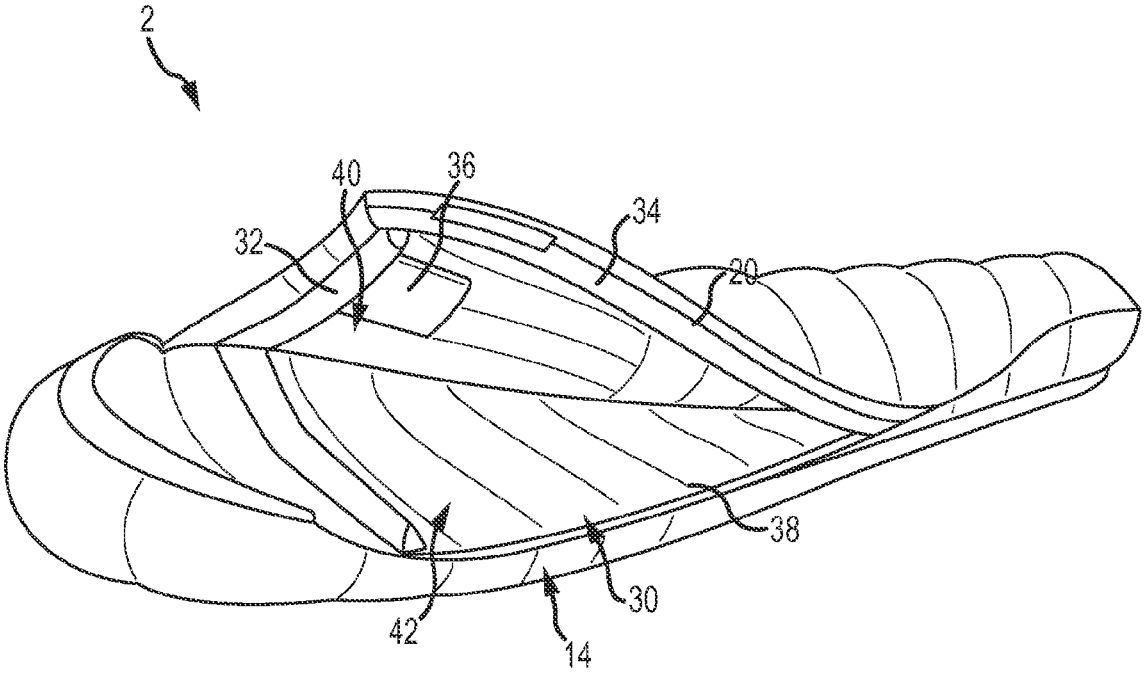
FIG. 5 is an isometric view of a sleeping bag with an inflatable ground mat, wherein the interior of the sleeping bag is visible.

Now referring to FIG. 5, a perspective view of an opened sleeping bag 2 is provided. As mentioned above, an opening edge may include a zipper 20, but any opening and closing means known in the art may be used to open and close the opening edge. For example, the opening and closing means may be a hook and loop material (e.g., Velcro), buttons, snaps, clips, elastic, chords, strings, laces, or other fastener. The opening and closing means may run from the top end 6 to the bottom end 8 of the sleeping bag 2 or may only run a partial distance along the length of the sleeping bag 2. Alternatively, the sleeping bag 2 may not comprise an opening and closing mechanism at all and rather may use elastic and/or one or more pull chords around an opening.

The opening edge may be opened and closed using any type of zipper 20 known in the art. For example, the zipper 20 may be a coil zipper, an invisible zipper, a metallic zipper, a plastic-molded zipper, an open-ended zipper, a close-ended zipper, an air-tight zipper, or a zipper with waterproof sheeting, to name a few. Additionally, the zipper 20 may comprise one or more sliders and one or more stops (e.g., top stop and bottom stop). Thus, the zipper 20 may have two sliders such that the zipper 20 can be opened from either end of the zipper 20. Each slider may have a pull tab or other pulling mechanism and the pulling mechanism may be able to be pulled from within the sleeping cavity or from outside of the sleeping bag 2.

Various embodiments of the present invention may include a zipper guard in addition to a zipper 20. The zipper guard may be a different material than the outer shell 14 or inner shell 30 of the sleeping bag 2. Accordingly, the zipper guard may be a stronger material or more tear-resistant material than either of the shells 14, 30 such that the user is less likely to rip the material proximate the zipper 20. Additionally, the zipper guard material may be tougher and less likely to rip if caught in the zipper 20. The zipper guard material may also be stiffer such that it is less likely to get caught in the zipper 20 in the first place.

In one embodiment, a sleeping bag 2 with an integrated air mattress is provided, where the sleeping bag 2 includes a top layer and a bottom layer. The top layer has a top layer opening edge and a top layer sealed edge, and the bottom layer has a bottom layer opening edge and a bottom layer sealed edge. The top layer opening edge and the bottom layer opening edge are releasably fastened along some portion of their length by a first fastener that is attached at a first attachment site. The bottom layer further includes a second attachment site for an upper portion of a second fastener. The air mattress has a perimeter and includes an inflatable portion and a peripheral extension. The peripheral extension includes a third attachment site for a lower portion of a second fastener. Upper and lower portions of the second fastener releasably fasten the air mattress to the sleeping bag 2.

In an alternate embodiment, the mat 4 has an outer shell 14 on the upper portion of the mat (not shown) rather than an inner shell 30 of the sleeping bag 2. Thus, the user lies on the outer shell of the mat 4 rather than on the inner shell 30 of the sleeping bag 2. In this embodiment, the outer shell 14 or the inflatable member may be a laminated polyester fabric, which is durable, airtight, and humidity resistant. In other embodiments, the outer shell 14 or the inflatable member may be made of 70-denier nylon, 200/210-denier nylon, 410/420-denier nylon, PVC-coated nylon, and PVC-coated polyester. The upper surface (adjacent the user) of mat's upper portion outer shell may be a laminated polyester fabric that is resistant to abrasion and UV light and may help prevent slippage between the user and the upper surface of the mat.

Figure 6:
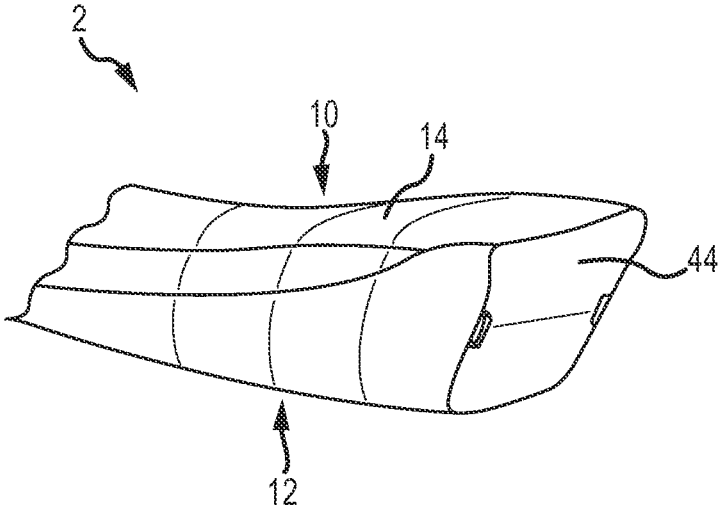
FIG. 6 is an isometric view of the bottom end of a sleeping bag with an inflatable ground mat, wherein the bottom end includes a footbox.

Now referring to FIG. 6, a detailed view of a bottom end 8 of a sleeping bag 2 is provided. FIG. 6 shows an upper side 10 and a bottom side 12 of the sleeping bag 2 as well as the outer shell 14 of the sleeping bag 2. Disposed at the bottom end 8 of the sleeping bag 2 is a footbox 44. In this embodiment, the footbox 44 is a rigid portion of the outer shell 14 which increases the distance between the upper side 10 and the bottom side of the sleeping bag 2. In some embodiments, the footbox 44 is affixed to the outer surface of the outer shell 14. In other embodiments, the footbox 44 is affixed between the inner surface of the outer shell 14 and the outer surface of the inner shell 30. In yet further embodiments, the footbox 44 is affixed to the inner surface of the inner shell 30. The footbox 44 may be affixed in these various configurations via a stitched seam, a welded seam, or any other means of integral fixation commonly known in the art or discussed elsewhere herein. In addition, the footbox 44 may be selectively interconnected in one of the above configurations via a zipper, Velcro®, or any other means of selective interconnection commonly known in the art or discussed elsewhere herein.

Figure 7:
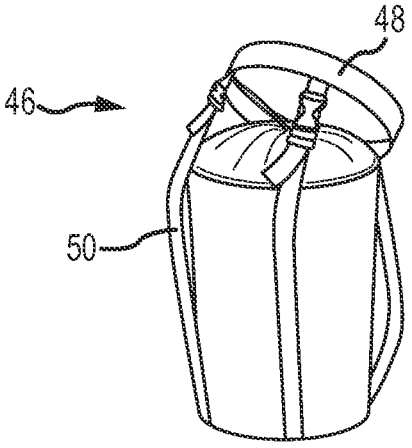
FIG. 7 is a side elevation view of a stuff sack used to house a sleeping bag with an inflatable ground mat.

Now referring to FIG. 7, perspective view of a compression stuff sack 46 used to store the sleeping bag 2 is provided. The stuff sack 46 comprises a lid 48 a bottom panel (not shown), a plurality of adjustable straps 50 positioned between the lid 48 and the bottom panel, and a cylindrically-shaped sack positioned between the adjustable straps 50. The lid 48 and bottom panel may be comprised of 210D nylon with a black coating. The adjustable straps 50 may be 1 inch in diameter, and the adjustable straps 50 may comprise side release buckles. The overall height of the stuff sack 46, once the sleeping bag 2 is disposed in the cylindrically-shaped sack and the adjustable straps 50 are tightened, is approximately 41 cm.

Figure 8:
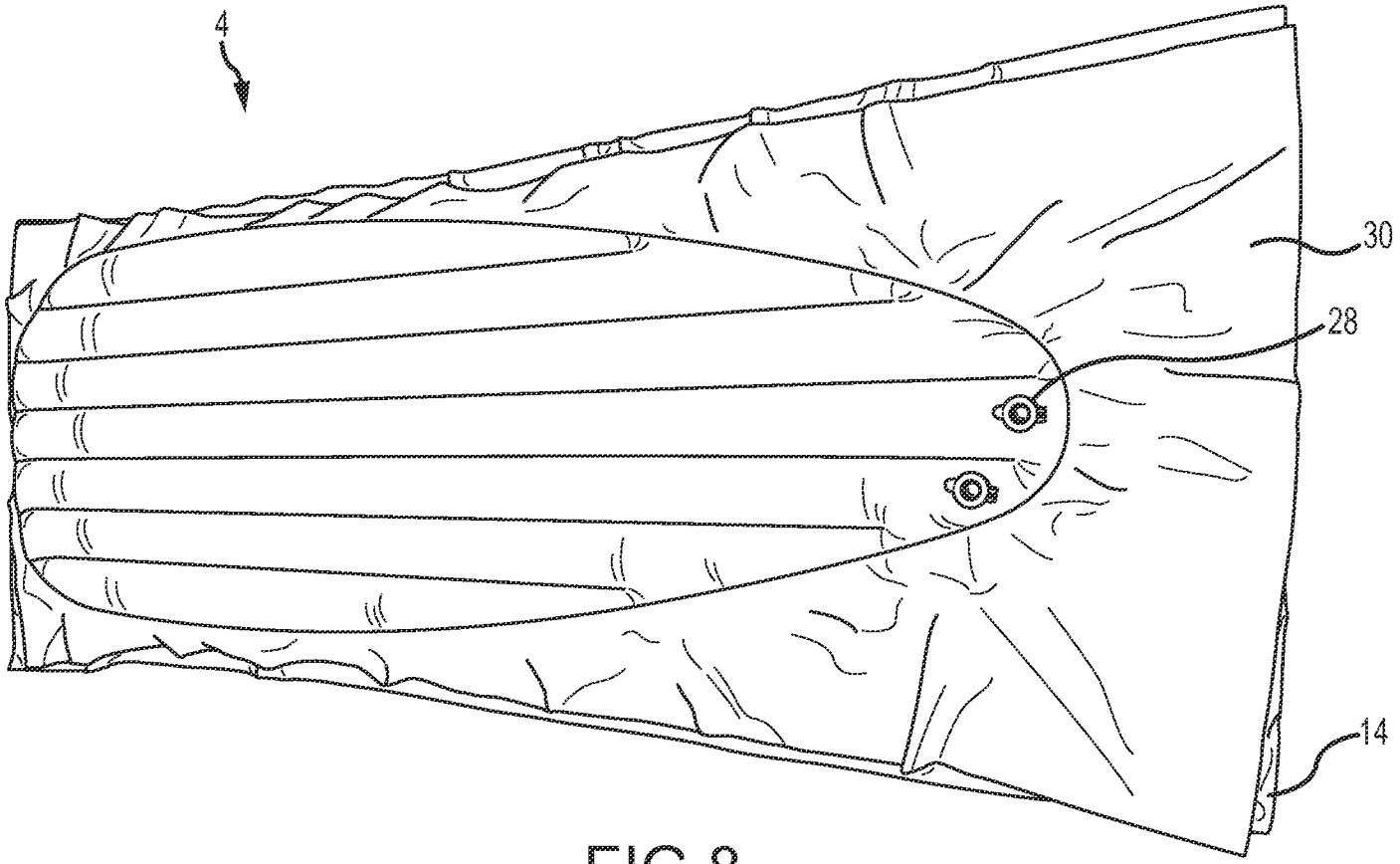
FIG. 8 is an isometric view of an inflatable ground mat which has been integrated with portions of an outer shell and an inner shell.

Now referring to FIG. 8, a top perspective view of a ground mat 4 before integration with a sleeping bag 2 is provided. In this embodiment, a portion of the inner shell 30 and a portion of the outer shell 14 have been interconnected to an inflatable member of the ground mat 4, but the shell portions have not yet been trimmed. This particular ground mad 4 is generally triangularly-shaped with the head of the user positioned at the base of the triangle, and the feet of the user positioned at the point of the triangle. One skilled in the art will appreciate a variety of ground mat 4 shapes.

The ground mat 4 depicted in FIG. 4 comprises two valves 28: one valve for allowing air or gas into the inflatable member of the ground mat 4, and one valve for allowing air or gas out of the inflatable member of the ground mat 4. The valves 28 may be any known valves in the art. The valves 28, for example, may be one-way valves, pad valves, FlatValves, screw in valves, quick valves, pinch valves, check valves, double-lock valves, Boston valves, Schrader valves, or self-inflating free flow valves, to name a few. Both valves 28 may be of the same type, while in other embodiments each valve 28 may be a different type. The valves 28 may also be flat and not on the mat's edge so that the valves 28 do not protrude and are thus protected and durable. Valves 28 such as those described in U.S. Pat. No. 6,832,629 to Wu, which is incorporated by reference in its entirety, may be used.

Means for selectively imparting a stream of air to the inflatable mat for inflating the inflatable mat 4 are very diverse. A hand pump, a foot pump, or a compressor may be operatively connected to the inflatable mat 4. Further, a valve 28 may be incorporated into the inflatable mat 4 that allows a user to inflate the inflatable mat 4 manually. Means of inflation are proposed to be by mouth, by normal bicycle valve and pump, or by compressed $CO_2$ canisters. Other air input devices may also be suitable, and the air input devices may be interchangeable. In one embodiment, the sleeping bag 2 comprises an inflatable ground mat 4 with a pump sack for rapid inflation.

Against referring to FIG. 8, in some embodiments of the present invention the inner shell 30 may have rip-stop lines to prevent tearing and ripping of the inner shell 30. In some embodiments, the inner shell 30 may be a laminated polyester fabric, which is durable, airtight, and humidity resistant. The inner shell's surface may be brushed polyester fabric that provides excellent slip resistance and comfort next to the skin.

Figure 9:
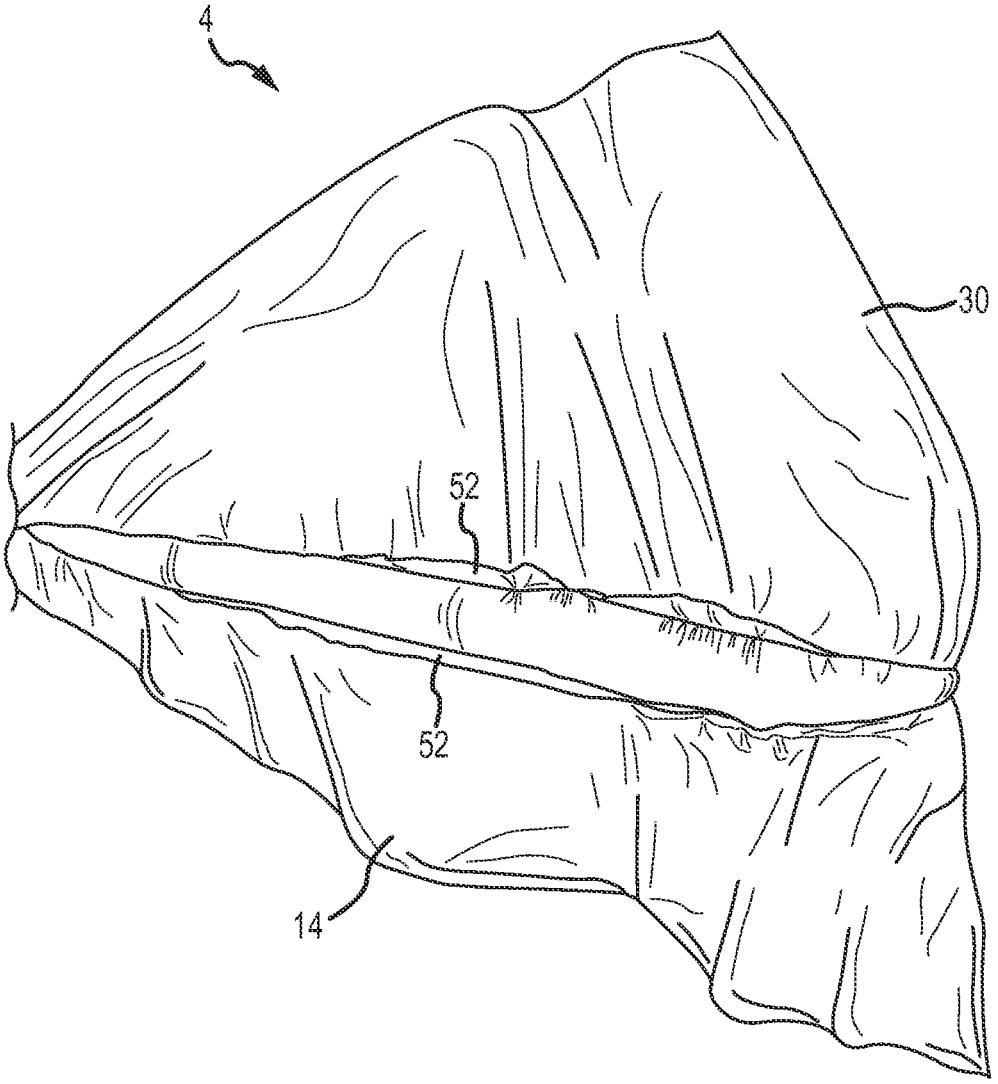
FIG. 9 is a side elevation view of an inflatable ground mat, the shells, and a flash.

Now referring to FIG. 9, a side perspective view of the ground mat 4 is provided wherein an inflatable member is positioned between the inner shell 30 and the outer shell 14. This inflatable member may be filled with insulation. Down mats 4 provide a high degree of insulation available without the bulk or weight. Thus, in some embodiments, the mat 4 may comprise approximately a 700-fill, goose down insulation, which offers an excellent combination of warmth, light weight, and compressibility. A non-toxic Nocar-treatment may be used to stop the down from clumping and to prevent mold from forming within the channels.

As shown in FIG. 9, a flash 52 is a perimeter of inflatable member material (and eventually a perimeter of inner shell 30 and outer shell 14 after trimming), which has a peripheral extension around portions of at least two sides of the inflatable mat 4. The peripheral extension is preferably not designed to contain pressurized air, and is, in this preferred embodiment, a flat flap, or flange, which may be some of the residual material, sometimes referred to as "flash," 52 left over from the manufacturing process. During fabrication, an air mattress is usually formed by taking two sheets of material and heat-sealing an airtight seam surrounding the inflatable portion. It is generally impractical to have the seam located precisely at the edge of the sheets of material, since minor misplacement or misalignment of either sheet can mean that the seam is improperly fashioned and thus an air-leak can occur. In order to avoid this, the seam is usually located inwardly from the edges, thus leaving a residue of flash 52 or a flange that is then generally trimmed off. The present invention makes use of this flange 52, avoiding the step of trimming, and thus simplifying manufacture.

Some prior art teaches that an air mattress alone, without insulation, will provide thermal insulation from the ground and thus the weight of the bag 2 can be reduced by eliminating insulation in, on, or near the air mattress. (See U.S. Pat. No. 6,675,414). However, this is not the case with sleeping bags 2 rated to low temperatures. Accordingly, embodiments of the present invention include insulation in the channels of the air mattress or inflatable member of the ground mat 4.

Figure 10:
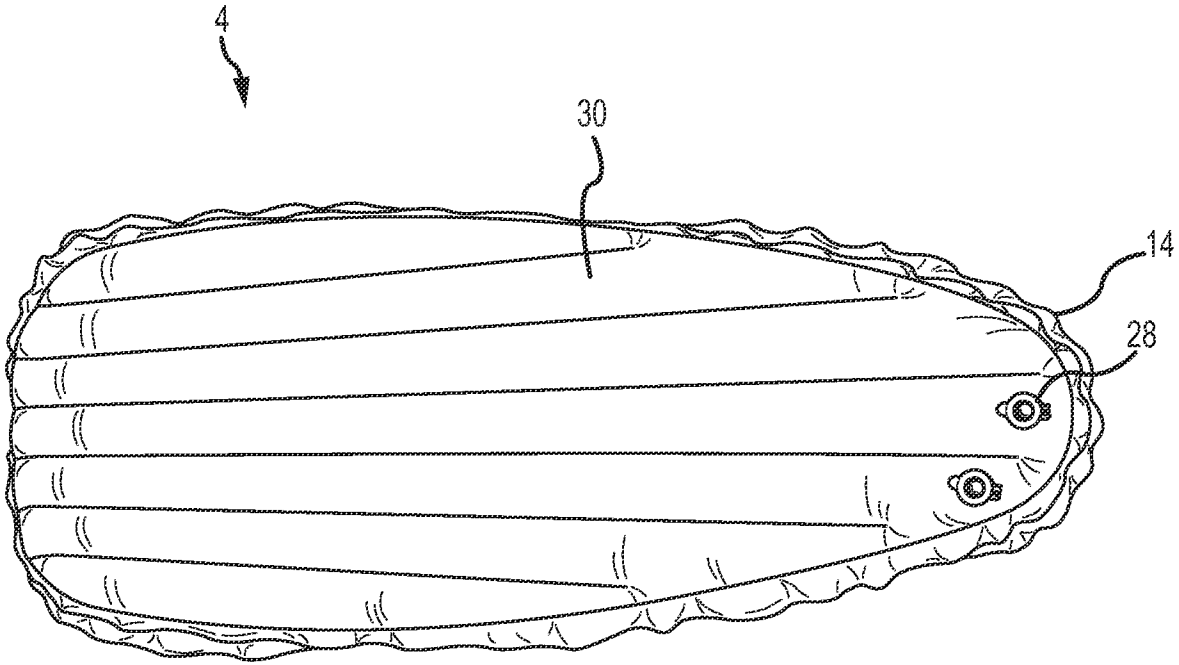
FIG. 10 is an isometric view of an inflatable ground mat with trimmed shells.

Now referring to FIG. 10, a top perspective view of the ground mat 4 is provided where the inner shell 30 and the outer shell 14 have been trimmed to the general outline of the ground mat 4. FIG. 10 shows the underside of an embodiment of a ground mat 4 to be integrated into a sleeping bag 2. The ground mat 4 has a channel configuration with baffles and welded seams running along the length of the ground mat 4. In one embodiment, a sleeping bag 2 is provided with an integrated air mattress comprising an inner shell 30, an outer shell 14, an inflatable mat 4, insulation, and one or more openings 28 to selectively inflate and deflate the mat.

The inflatable mat 4 may be a network of inflatable tubes arranged in a linear pattern and defines a plurality of channels. The design of the inflatable channels or use of baffles eliminates convection currents that can form in large air pockets, requires less volume of air to inflate than conventional air mattresses, and keeps the insulation in the channels evenly distributed through the mat 4. Furthermore, as long as the inflatable tubes are not spaced too far apart, the inflatable mat 4 provides support that is at least as good as, if not better than, conventional air mattresses.

The mat 4 is sandwiched between an inner shell 30 and an outer shell 14. The tubes of the mat 4 may run vertically along the length of the user or horizontally perpendicular to the user. The mat 4 may be manufactured of 20D Polyu form Fung Yi material in one embodiment. Generally, the inflatable ground mat 4 and/or inflatable member may be manufactured of an impermeable material such that it is capable of retaining air.

The tubing and the air in the tubing support the weight of the user and allow the insulation in the tubing to remain uncompressed and effective because there is now airflow through the tubing with insulation. The tubing may also prevent condensation from occurring under the user's body.

In another embodiment, the mat material or the mat 4 itself may comprise a poly honeycomb structure. In some embodiments the mat 4 may have an internal structure to hold the mat's shape and hold the insulation in place. The internal structure may be fabric, another durable material, or the same material as the inner shell 30.

In one embodiment, the seams of the mat 4 may be high frequency welded for durability. The welded construction stands up to heavy use. Additionally, baffled chambers (sewn pockets to distribute insulation evenly) may be used to eliminate nagging cold spots that can ruin a night's sleep. Some embodiments may also comprise a side-block baffle, which is piece of fabric sewn into the side of the bag 2 to prevent the movement of down or other insulation. The seams of the mat 4 provide additional comfort, increase the heat retention to allow the sleeping bag 2 and mat 4 system to be rated to lower temperatures, keep the insulation in predetermined locations, and allow the chambers to transition from air to insulation. The thermal retention and temperature rating for the ground mat 4 may vary based on the specific embodiment. Accordingly, some embodiments have more insulation than other embodiments and retain more heat; therefore, the embodiments with more insulation have a lower temperature rating than the embodiments with less insulation (i.e., are rated to be used in colder/lower temperatures). Further, some embodiments have insulation throughout the length and width of the mat 4 while other embodiments only have insulation in select locations.

In one embodiment, the sleeping bag 2 has an upper portion openable and closable to a lower portion with a removable liner capable of disposition therebetween for providing additional warmth to the sleeping individual. The lower portion is embedded with a resilient ground mat 4 for support and disposed adjacent the ground mat 4 and throughout the lower portion of the sleeping bag 2 are interconnected air bladders that when inflated contour and conform to the user's body for supporting muscular-skeletal areas such as the head and neck. For example, should the user desire more support about the head, neck and shoulders, a head bladder and top portions of a central bladder and side bladders can be inflated to a greater degree than the bottom portions of these bladders.

Figure 11:
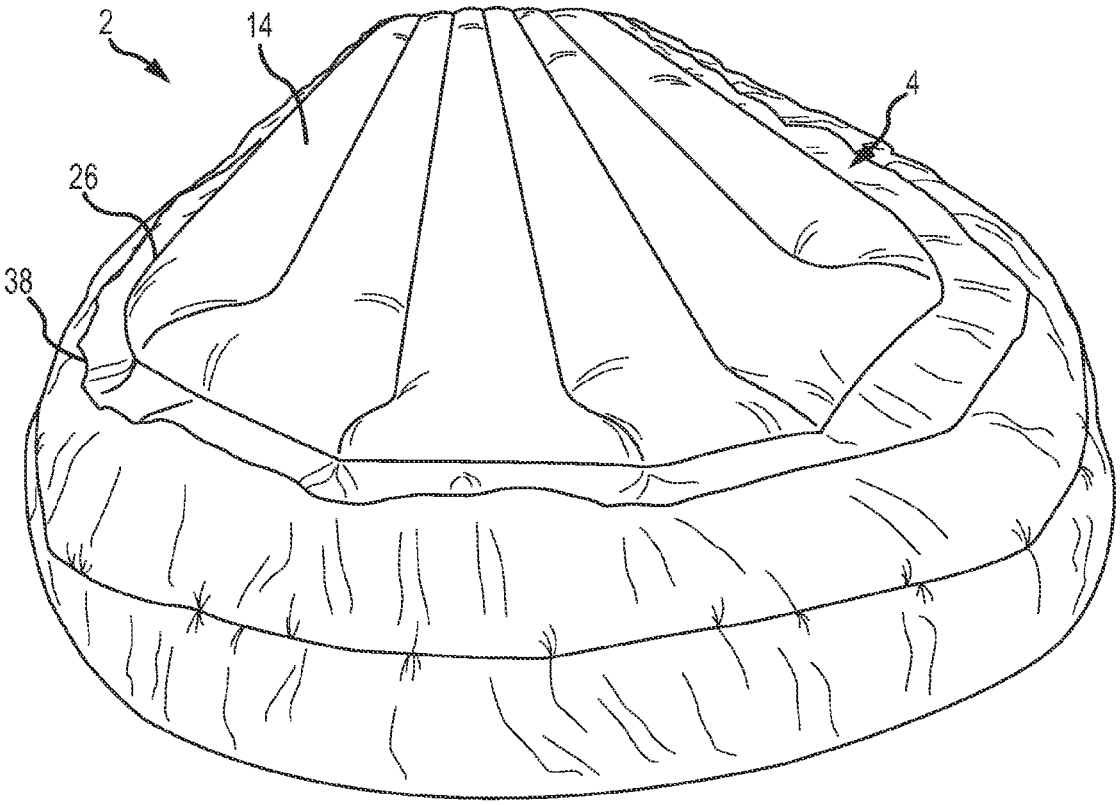
FIG. 11 is an isometric view of a lower side of a sleeping bag with an inflatable ground mat.

Now referring to FIG. 11, a top, isometric perspective view of the top (head) end 6 of the underside of the sleeping bag 2 is provided. In this embodiment, the inflatable ground mat 4 has been integrated into the sleeping bag 2. In some embodiments, the outer shell 14 may have rip-stop lines to prevent tearing and ripping of the outer shell 14. The outer shell 14 may be a laminated polyester fabric, which is durable, airtight, and humidity resistant. Some embodiments of the present invention may include a sleeping bag 2 with a differential cut, i.e., a sleeping bag 2 with a smaller inside than outside to minimize cold spots.

Actually deploying the sleeping bag 2 and ground mat 4 for use is essentially the same as using a conventional sleeping bag. After selecting and clearing the appropriate site for the sleeping bag 2, the sleeping bag 2 is removed from the travel bag. Then the user blows air into inflation valve 28 of the mat 4 until the mat 4 is inflated to the desired level. The valve 28 is then closed and the mat placed in its proper position. The upper portion is unzipped from the lower portion to allow ingress and egress.

While various embodiments of the present invention have been described in detail above and in the attached appendices, it is apparent that modifications and alterations of those embodiments will occur to those skilled in the art. However, it is to be expressly understood that such modifications and alterations are within the scope and spirit of the present invention, as set forth in the following claims. Further, the invention(s) described herein is capable of other embodiments and of being practiced or of being carried out in various ways. It is to be understood that the phraseology and terminology used herein is for the purpose of description and should not be regarded as limiting.

What is claimed is:

1. A sleeping bag and combination ground mat, comprising:

an outer shell having an upper portion and a lower portion;

an inner shell having an upper portion and a lower portion;

an upper portion of said sleeping bag comprised of said inner shell upper portion and said outer shell upper portion;

a lower portion of said sleeping bag comprised of said inner shell lower portion, and said outer shell lower portion;

a first opening defined by an edge of said upper portion of said sleeping bag an edge of said lower portion of said sleeping bag;

a means for opening and closing said first opening;

a sleeping cavity defined by said inner shell upper portion, said inner shell lower portion, a closed side, and said first opening;

a closed bottom end comprising a rigid footbox, wherein said rigid footbox separates said upper portion and said lower portion of said sleeping bag a top end opposite said bottom end and comprising a second opening;

a ground mat interconnected to said lower portion of said sleeping bag, wherein said ground mat comprises:

an inflatable member forming an enclosed volume, said inflatable member having a top side and a bottom side, said top side positioned opposite said bottom side;

a plurality of baffles positioned between said top side and said bottom side of said inflatable member, said plurality of baffles forming a plurality of channels;

an insulation material disposed in at least one of said plurality of channels; and one or more openings to selectively inflate and deflate said enclosed volume of said inflatable member.

2. The sleeping bag of claim 1, wherein said insulation material is comprised of at least one of a down, a wool, a PolarGuard, a Quallofil, a Hollofil, a Thermolite, a Downtek GGD 850, and a Climashield HL 5.4 OZ/SQ YD.

3. The sleeping bag of claim 1, wherein said inflatable member is comprised of at least one of a laminated polyester material, a 70-denier nylon, a 200/210-denier nylon, a 410/420-denier nylon, a PVC-coated nylon, and a PVC-coated polyester.

4. The sleeping bag of claim 1, wherein said means for opening and closing said first opening is at least one of a zipper and a hook and loop material.

5. The sleeping bag of claim 1, wherein said top end comprises a hood defining said second opening, and wherein a tightening means is substantially disposed about the perimeter of said second opening to control the diameter of said second opening.

6. The sleeping bag of claim 1, further comprising a draft collar disposed on the inner side of said upper portion of said sleeping bag, said draft collar positioned proximate to said second opening.

7. The sleeping bag of claim 1, wherein said plurality of baffles is oriented along a substantially longitudinal direction of said sleeping bag.

8. The sleeping bag of claim 1, wherein said ground mat comprises a plurality of inflatable members, and wherein one inflatable member comprises an insulation material with a different thermal resistance than another insulation material of another inflatable member.

9. The sleeping bag of claim 1, wherein said ground mat is selectively interconnected to said lower portion of said sleeping bag by at least one of a zipper, a hook and loop material, at least one button, at least one snap fastener, at least one clip, and a string material.

10. The sleeping bag of claim 1, wherein said ground mat is interconnected to said lower portion of said sleeping bag by at least one of a stitched seam, a welded seam, an adhesive, and a rip-stop seam.

11. The sleeping bag of claim 1, wherein said ground mat is comprised of a plurality of segments.

12. The sleeping bag of claim 1, where said one or more openings is a first valve configured to allow a gas to enter said enclosed volume of said inflatable member and a second valve configured to allow a gas to exit said enclosed volume of said inflatable member.

13. The sleeping bag of claim 1, wherein said plurality of baffles is oriented along a substantially lateral direction of said sleeping bag.

14. A sleeping bag with an integrated ground mat, comprising:

an outer shell having an upper portion and a lower portion;

an inner shell having an upper portion and a lower portion;

an upper portion of said sleeping bag comprised of said inner shell upper portion and said outer shell upper portion;

a lower portion of said sleeping bag comprised of an integrated ground mat, said inner shell lower portion, and said outer shell lower portion;

a first opening defined by an edge of said upper portion of said sleeping bag and an edge of said lower portion of said sleeping bag;

a zipper for opening and closing said first opening;

a sleeping cavity defined by said inner shell upper portion, said inner shell lower portion, a closed side, and said first opening;

a closed bottom end comprising a rigid footbox, wherein said rigid footbox separates said upper portion and said lower portion of said sleeping bag;

a top end opposite said bottom end and comprising a second opening;

wherein said ground mat comprises:

an inflatable member forming an enclosed volume, said inflatable member having a top side and a bottom side, said top side positioned opposite said bottom side;

a plurality of baffles positioned between said top side and said bottom side of said inflatable member, said plurality of baffles oriented along a substantially longitudinal direction of said inflatable member, and said plurality of baffles forming a plurality of channels;

an insulation material disposed in at least one of said plurality of channels; and one or more openings to selectively inflate and deflate said enclosed volume of said inflatable member.

* * * * *